US006951296B2

(12) United States Patent
Siek

(10) Patent No.: US 6,951,296 B2
(45) Date of Patent: Oct. 4, 2005

(54) METHOD AND DEVICE FOR PREVENTING SLAG FROM FLOWING ALONG WHEN TAPPING A MOLTEN METAL

(75) Inventor: Horst Siek, Georgsmarienhütte (DE)

(73) Assignee: Georgsmarienhütte GmbH, Georgsmarienhütte (DE)

( * ) Notice: Subject to any disclaimer, the term of this patent is extended or adjusted under 35 U.S.C. 154(b) by 213 days.

(21) Appl. No.: 10/297,295

(22) PCT Filed: Mar. 27, 2002

(86) PCT No.: PCT/DE02/01117

§ 371 (c)(1),
(2), (4) Date: Dec. 4, 2002

(87) PCT Pub. No.: WO02/081759

PCT Pub. Date: Oct. 17, 2002

(65) Prior Publication Data

US 2003/0137085 A1 Jul. 24, 2003

(30) Foreign Application Priority Data

Apr. 5, 2001 (DE) ..... 101 17 181

(51) Int. Cl.[7] ..... C21B 3/04
(52) U.S. Cl. ..... 222/603; 266/230
(58) Field of Search ..... 222/603, 590; 266/45, 227, 230

(56) References Cited

U.S. PATENT DOCUMENTS 4,767,036 A * 8/1988 Schleimer et al. ..... 222/590
4,840,355 A * 6/1989 LaBate ..... 266/220

FOREIGN PATENT DOCUMENTS

| | | |
|---|---|---|
| EP | 0 097 610 | 1/1984 |
| EP | 1 172 162 | 1/2002 |
| JP | 59 126 713 | 7/1984 |
| JP | 01 201 410 | 8/1989 |

* cited by examiner

*Primary Examiner*—Scott Kastler
(74) *Attorney, Agent, or Firm*—Collard & Roe, P.C.

(57) ABSTRACT

The invention relates to a device for preventing slag from flowing along when tapping a molten metal out of a metallurgical vessel, whereby the tap opening of the vessel is formed out of interchangeable pipes, which are located one above the other, made of wear-resistant refractory material, and enclosed by tap framing blocks, whereby the lower end of the tap interchangeable system, which is constructed as described, is formed by a cup block against which a slide that closes the opening rests. According to the invention, axially extending channels that are open at both ends of the pipe are provided in the pipe wall of at least the interchangeable pipe that leads into the interior of the vessel. Said channels are connected to a gas supply at the pipe end facing away from the interior of the vessel.

10 Claims, 4 Drawing Sheets

Figure 1:
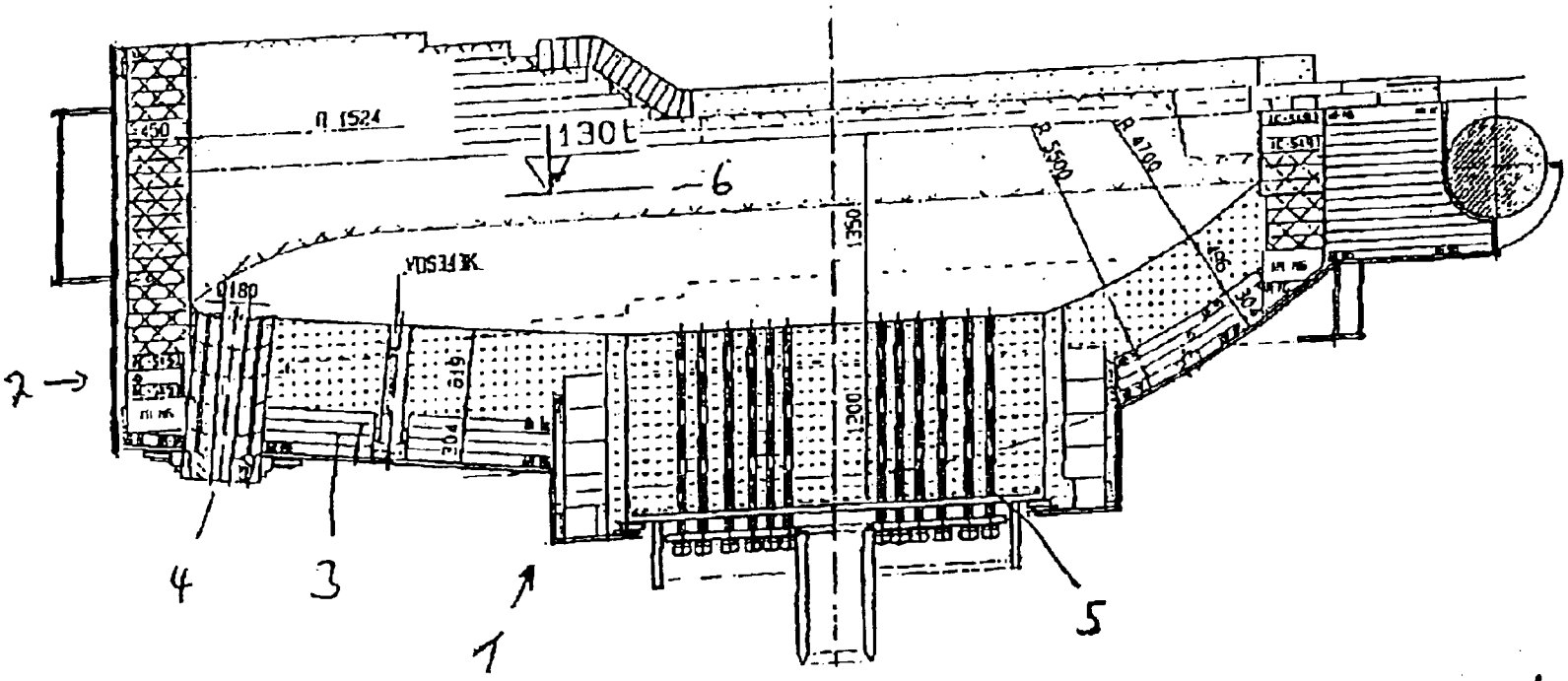

METHOD AND DEVICE FOR PREVENTING SLAG FROM FLOWING ALONG WHEN TAPPING A MOLTEN METAL

CROSS REFERENCE TO RELATED APPLICATIONS

Applicant claims priority under 35 U.S.C. §119 of German Application No. 101 17 181.1, filed Apr. 5, 2001. Applicant also claims priority under 35 U.S.C. §365 of PCT/DE02/01117 filed Mar. 27, 2002. The international application under PCT article 21(2) was not published in English.

The invention relates to a method for preventing slag from flowing along when tapping a molten metal out of a metallurgical vessel.

These vessels can be, for example but not exclusively, vessels such as those used for steel production, in other words a converter, or the vessel of an electric furnace.

In the following, the invention will be presented using the example of an electric furnace.

Such a vessel has an approximately oval or pear-shaped shape when viewed from the top, whereby the tap opening is provided in the front bottom region that comes to a point. In the normal position, i.e. before tapping, the level of the melt is approximately 1 m to 1.5 m above the tap opening.

This tap opening is plugged up with a fill material and is closed off by means of a slide at the bottom. The fill material forms a hill that projects into the container interior, above the tap opening.

For tapping, i.e. for filling the melt into the pan in which the steel is subjected to secondary metallurgy processes, the vessel is pivoted into the tapping position, so that the tap opening now forms the lowest region of the vessel. In this position, the slide is opened and the fill material in the tap opening is removed.

The outflowing melt forms a vortex (vortex effect) above the tap opening, which vortex entrains the slag floating on the melt, by means of the suction effect, and this is undesirable for metallurgical reasons.

Methods known until now for preventing or reducing this vortex effect have not proven to be useful up to the present.

The invention is therefore based on the task of conducting a method of the type stated initially, in such a way that elimination of the vortex effect as discussed is possible in simple manner.

Another task of the invention is to indicate a device for implementing the method.

The invention accomplishes the first part of the task using the following process steps:

a) pivoting the vessel into the tapping position;

b) blowing gas through the channels that surround the tap opening, counter to the flow direction of the liquid metal, when tapping the melt located in the vessel;

c) opening the tap opening;

d) pivoting the vessel back, until the tap opening is no longer covered by the melt;

e) ending the blowing in of gas.

It is known to blow gas into a melt.

In the secondary metallurgical treatment of the steel being produced, gas is blown into the melt from below, through the bottom of the pan, in order to produce a circulation process in the melt, so that homogenization of the melt temperature as well as of the alloy components dissolved in the melt is achieved.

In such gas flushing systems, square or round nozzle blocks are set into the bottom of the pan, with conically shaped scouring blocks set into them, which are designed in such a way that the gas can stream into the melt through them. Several types are known, for example porous scouring blocks, slotted scourers, star scourers, etc.

In order to prevent the gas from exiting out of the scouring blocks on the side, these scouring blocks are surrounded with a metal mantle.

The height of the steel level in the pan, above the scouring blocks, is up to 4 m.

When the gas is blown into the melt from below, a so-called "bald head" is observed at the surface of the melt. As the name allows one to presume, the melt surface is absolutely free of foreign bodies at this location.

The invention takes advantage of this effect.

The tap opening in the vessel of an electric furnace (analogous to a converter) is formed by so-called interchangeable pipes, several of which, on top of one another, form the opening, which becomes narrower towards the bottom. Such interchangeable pipes consist of magnesite, corundum concrete, or similar refractory materials. These interchangeable pipes are surrounded by tap framing blocks, whereby a join exists between the interchangeable pipes and the tap framing blocks, which join is filled with a refractory material. Towards the bottom, this system is closed off by means of a so-called cup block. In this connection, the opening of the cup block can be closed off by means of a slide.

According to the invention, it is now provided that similar to the scouring stones just mentioned, axially extending channels are provided in the wall of the interchangeable pipes (at least the top one or the top two), which channels open into the interior of the vessel. The channels are connected with a gas supply.

As soon as the vessel has been tilted into the tapping position, the supply of gas is started. The gas that exits from the channels removes the hill formed of fill material above the tapping opening. Then the slide is pivoted away below the cup block, and the fill material within the tap opening is removed. The melt can now flow out into the pan, whereby the aforementioned vortex forms above the tap opening. The gas that flows into the melt forms the "bald head" as described, above the channel openings, similar to the scouring process, which means that in this region, the slag is pressed away towards the outside and prevented from flowing into the pan through the tap opening.

Blowing the gas in is continued until the vessel has been pivoted back and the tap opening is no longer covered with melt.

It is understood as a matter of course that a gas is used that does not disturb the metallurgical properties of the melt.

In order for the gas to be able to exit from the interchangeable pipes on the side, these are surrounded on the outside by a steel mantle made of rust-free material.

Although it is possible that the channels pass through all the interchangeable pipes arranged on top of one another, it is preferably provided, however, to furnish only the top one or the top two interchangeable pipes with channels. These two top interchangeable pipes can also be formed in one piece and therefore form a unit.

The arrangement and the geometry of the channels result from the application requirements in each instance.

In the production and the geometry of the channels, it is possible to draw on the experience gained in the field of scouring blocks.

In order to be able to apply the gas uniformly to all the gas-carrying channels, the bottom channel-carrying interchangeable pipe is provided with an annular chamber at its bottom, into which all the channels open, and into which the gas supply pipe opens, which pipe is arranged, for example, in the region between the interchangeable pipes and the tap framing blocks that surround them. The already existing joint between the two elements can be utilized for this purpose, or a groove is provided in the outside of the interchangeable pipes that do not have any channels.

In order to prevent electrical sparkover onto the gas supply pipes and their destruction or damage, either the metallic sheath of the metallurgical vessel may be laid to the same electrical potential as the gas supply pipes, or, alternatively, the gas supply pipes may be insulated from the potential that is applied to the metallurgical vessel.

The invention will be presented below, using drawings, and explained in greater detail.

The drawings show

Figure 2:
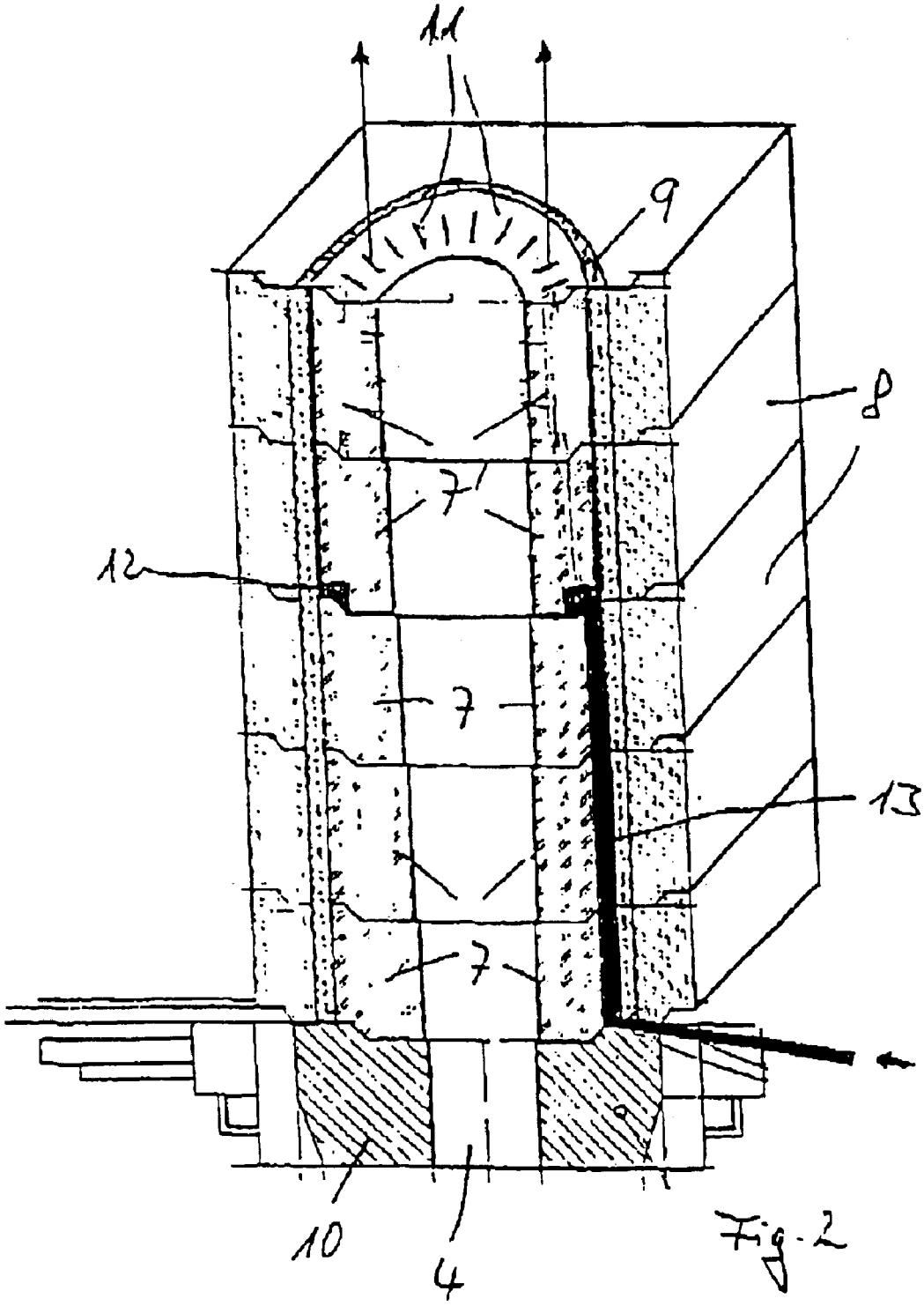
Figure 3:
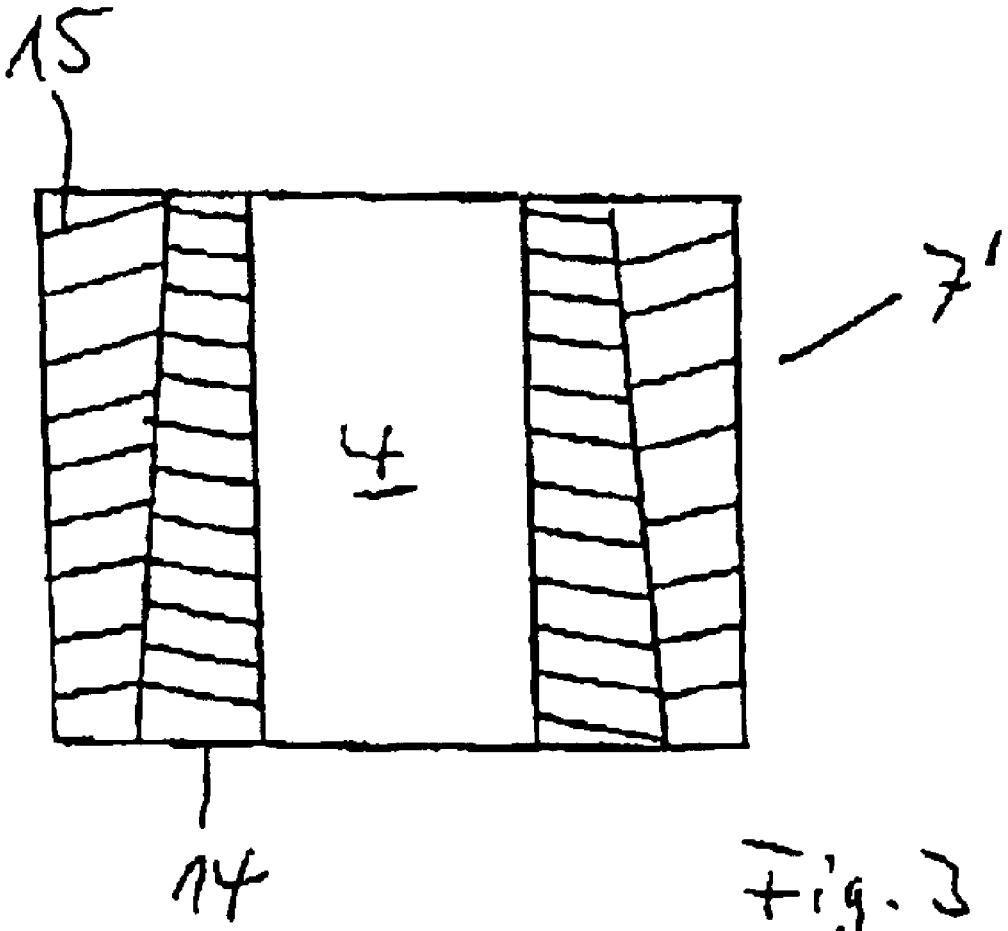
Figure 4A:
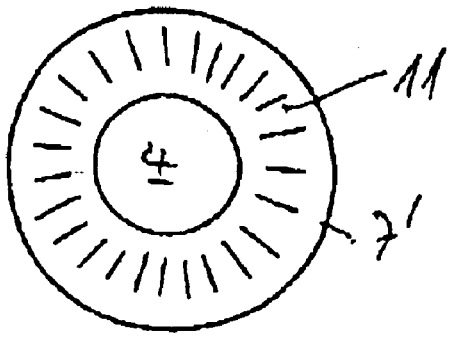
Figure 4B:
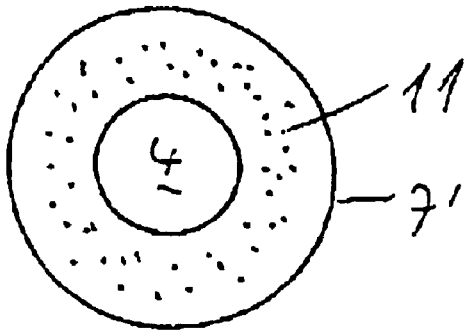
Figure 4C:
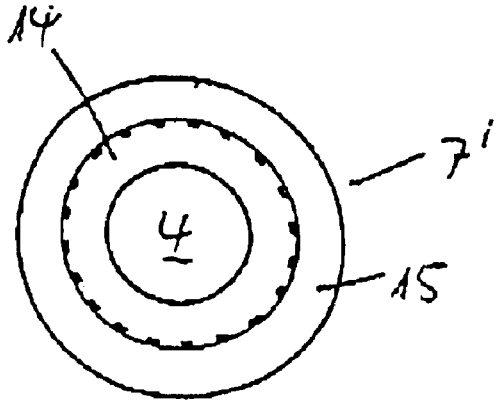

FIG. 1: a vessel of an electric furnace in cross-section;

FIG. 2: the tapping system of a vessel according to FIG. 1 in a perspective view, and in cross-section;

FIG. 3 a special embodiment of an interchangeable pipe, in cross-section;

FIGS. 4*a* to 4*c*: three possible channel geometries in the interchangeable pipes.

FIG. 1 shows the vessel of an electric furnace for steel production in lengthwise cross-section, the vessel being identified, in general, with the reference number 1. In a top view, the vessel 1 has an approximate pear shape, whereby the tap opening 4 is located in the bottom 3 of the vessel 1, at the end 2 that comes to a sharper point. The anode 5 is arranged in the approximately central region of the bottom 3. The cathode and the lid of the vessel are not shown.

The vessel 1 can be tilted about an axis that passes perpendicular through the plane of the paper. Scrap is primarily melted in this vessel 1, whereby the melt achieves the level indicated with 6 after the melting process.

FIG. 2 shows the tapping system with the tap opening 4, on a larger scale. In the present case, this tapping system is composed of five interchangeable pipes 7, 7', arranged on top of one another, the opening diameters of which become smaller towards the bottom. The interchangeable pipes 7, 7' are surrounded by cubically structured tap framing blocks 8, whereby the join 9 between the interchangeable pipes 7, 7' and the tap framing blocks 8 is filled with a refractory material. The tapping system is closed off at the bottom by means of a cup block 10, the opening of which can be closed with a slide, not shown.

The top two interchangeable pipes 7' have channels 11 arranged to extend axially in the pipe wall, which channels produce a connection between the interior of the vessel 1 and an annular chamber 12, which is provided at the bottom of the bottom interchangeable pipe 7'. A gas supply line 13 that leads to the bottom between the interchangeable pipes 7 and the tap framing blocks 8 and is passed at a slant towards the outside between the bottom tap framing block 8 and the cup block opens into the annular chamber 12.

FIG. 3 shows a possible embodiment of an interchangeable pipe 7'. This interchangeable pipe 7' is composed of two parts, namely of an inside part 14, which has a conical structure, whereby the outside mantle of this cone narrows towards the top. This inside cone 14 is inserted into an outside part 15, the inside surface of which is structured to be complementary to the outside surface of the inside cone 14.

A top view of such an interchangeable pipe 7' is shown in FIG. 4*c*. Here, the channels 11 for the gas supply are formed by the grooves molded into the outside surface of the inside cone 14.

Other possible forms of the channels can be seen in FIG. 4*a* and FIG. 4*b*.

In FIG. 4*a*, the channels 11 are structured as radially arranged slits, while the channels are formed by a plurality of bores in the example of FIG. 4*b*.

Other geometries or embodiments of the channels are possible, for example channels in star shape or the like.

The method according to the invention will be briefly presented in the following:

After the melting process, the vessel 1 is tipped forward, so that the tap opening 4 forms the lowest part of the vessel 1.

As soon as the vessel is in this position, the process of blowing gas into the melt by way of the channels 11 is started. Only then is the tapping system opened, so that the melt can flow down through the tap opening 4 into a pan that is placed underneath it (not shown). Blowing gas into the melt by way of the channels 11 has the result that the formation of a vortex above the tap opening 4 is counteracted, so that no slag can be entrained into the pan through the tap opening 4 by this vortex.

A so-called "bald head" forms above the tap opening 4 because of the gas that is blown in, i.e. this is a region in which the slag is forced away to the side.

When the fill level in the pan has reached the desired value, the vessel 1 is pivoted back.

When the tap opening 4 is no longer covered by melt, the gas supply is shut off.

What is claimed is:

1. A device for preventing slag from flowing along when tapping a molten metal out of an interior of a metallurgical vessel having a tap opening comprising:

(a) a plurality of interchangeable pipes formed of wear-resistant refractory material arranged on top of one another, said plurality of interchangeable pipes comprising an interchangeable pipe opening into the interior of the vessel;

(b) a plurality of tap framing blocks enclosing said interchangeable pipes;

(c) a cup block forming a lower end of said device and having a closable opening;

(d) axially extending channels provided in a pipe wall and open at both ends of at least said interchangeable pipe that opens into the interior of the vessel; and (e) a gas supply connected to said channels at a pipe end facing away from the interior of the vessel.

2. The device according to claim 1 wherein each interchangeable pipe in which said channels are arranged is surrounded by a sheet-metal mantle of stainless steel.

3. The device according to claim 1 wherein said channels comprise radially arranged slits surrounding an opening in the pipe in which said channels are arranged.

4. The device according to claim 1 wherein said channels comprise uniformly distributed bores surrounding an opening in the pipe in which said channels are arranged.

5. The device according to claim 1 wherein each interchangeable pipe in which said channels are arranged comprises a conical inside pipe and a complementary outside pipe and said channels are formed by an interstice between said inside and outside pipes and channel-forming grooves provided either in an outside surface of said inside pipe or an inside surface of said outside pipe.

6. The device according to claim 1 wherein said gas supply opens into an annular chamber arranged below a lowermost one of the plurality of interchangeable pipes that has said channels and impacts the channels of each interchangeable pipe in which channels are arranged.

7. The device according to claim 6 wherein said gas supply comprises a pipe that opens above said cup block into a connection between said interchangeable pipes and said tap framing blocks and extends axially to said annular chamber.

8. The device according to claim 1 wherein channels are formed in at least two interchangeable pipes, said at least two interchangeable pipes forming an integral unit.

9. The device according to claim 1 wherein said gas supply comprises a plurality of gas supply pipes, and the metallurgical vessel has a metallic sheath lying at a same electrical potential as said gas supply pipes.

10. The device according to claim 1 wherein said gas supply comprises a plurality of gas supply pipes insulated from an electrical potential applied to the metallurgical vessel.

* * * * *